US007129433B2

(12) United States Patent
Tokusashi

(10) Patent No.: US 7,129,433 B2
(45) Date of Patent: Oct. 31, 2006

(54) BUTTON ASSEMBLY AND AN ELECTRONIC DEVICE

(75) Inventor: Mitsuyuki Tokusashi, Miyagi (JP)

(73) Assignee: Sony Computer Entertainment Inc., Tokyo (JP)

( * ) Notice: Subject to any disclaimer, the term of this patent is extended or adjusted under 35 U.S.C. 154(b) by 0 days.

(21) Appl. No.: 11/217,118

(22) Filed: Aug. 31, 2005

(65) Prior Publication Data

US 2006/0060463 A1 Mar. 23, 2006

(30) Foreign Application Priority Data

Sep. 17, 2004 (JP) ..... 2004-272634

(51) Int. Cl.
*H01H 13/705* (2006.01)

(52) U.S. Cl. ..... 200/344; 200/517; 200/345

(58) Field of Classification Search ..... 200/5 A, 200/517, 520, 341–345
See application file for complete search history.

(56) References Cited

U.S. PATENT DOCUMENTS 3,681,555 A * 8/1972 Ohkita ..... 200/344
5,362,934 A * 11/1994 Inagaki et al. ..... 200/520
5,406,277 A * 4/1995 Lee ..... 200/345
5,456,541 A * 10/1995 Ching-Shui ..... 200/345
6,034,340 A * 3/2000 Aoki et al. ..... 200/345
6,060,672 A * 5/2000 Sugihara ..... 200/61.1
6,192,815 B1 * 2/2001 Duttenhofer ..... 200/341
6,284,992 B1 * 9/2001 Richter ..... 200/344
6,580,043 B1 * 6/2003 Spratte ..... 200/517
6,964,532 B1 * 11/2005 Lu ..... 200/5 A

* cited by examiner

*Primary Examiner*—Michael A Friedhofer
(74) *Attorney, Agent, or Firm*—Katten Muchin Rosenman LLP

(57) ABSTRACT

A button assembly comprises a cylindrical key top (132) loosely inserted into a hole (126) formed on a casing (10). The upper surface of the key top (132) is a pressed face (134). The assembly further comprises a deformation member (150) disposed below the key top (132) in the pressing direction. The deformation member (150) deforms to produce repulsive force when the key top (132) is pressed down. The assembly further comprises a conductive member (154) attached on the bottom of the deformation member (150), and switch contacts (166) which come into contact with the conductive member (154) and become conductive by the deformation of the deformation member (150). The central axis of the key top (132) and the central axis of the conductive member (154) are separated with certain spacing. The key top (132) has a hang-over member extending from the lower end of said key top over the central axis of the conductive member (154). The hang-over member (142) moves to the pressing direction with the key top (132) when the key top is pressed down, and the bottom of the hang-over member (142) presses the deformation member (150) in the pressing direction.

3 Claims, 12 Drawing Sheets

BUTTON ASSEMBLY AND AN ELECTRONIC DEVICE

BACKGROUND OF THE INVENTION

1. Field of the Invention

This invention relates to the structure of an electronic device, and more particularly, to the structure of a push button installed in the electronic device.

2. Description of the Related Art

In recent years, electronic devices such as a portable gaming machine, a personal digital assistance (PDA) and a cellular phone become widespread. Users can enjoy playing electronic game, sending an E-mail, or making a call with the electronic device anywhere. Most of these electronic devices have push buttons for operation.

Recently, both contents and graphic performance of electronic game has been improved. A larger liquid crystal display is installed on the portable electronic device. In some cases, operating devices such as push buttons need to be arranged adjacent to the liquid crystal display according to designer's request. Furthermore, because of advancement of the electronic devices such as gaming machines, packaging density of the casing has been increased. Therefore, in some cases, operation devices such as push buttons need to be positioned adjacent to some units such as a hard disk drive, a wireless communication unit, or a camera unit.

Generally, a molded part for a key top of the push button, a rubber member positioned below the molded part for producing repulsion of the button, and switch contacts need to be aligned coaxially. Therefore, it is difficult to position the rubber part and the switch contacts adjacent to other unit while reserving the size of the push button for not decreasing operability.

SUMMARY OF THE INVENTION

The present invention was devised in view of the above problem and has an object of providing a button assembly which can be positioned adjacent to other unit while reserving the size of the push button.

One aspect of the invention is a button assembly. The assembly comprises a cylindrical key top loosely inserted into a hole formed on a casing. The upper surface of the key top is a pressed face. The assemble further comprises a deformation member disposed below the key top in the pressing direction. The deformation member deforms to produce repulsive force when the key top is pressed down. The assemble further comprises a conductive member attached on the bottom of the deformation member, and switch contacts which come into contact with the conductive member and become conductive by the deformation of the deformation member. The central axis of the key top and the central axis of the conductive member are separated with certain spacing.

According to this aspect, the key top, the conductive member and the switch contacts need not to be aligned coaxially. Therefore, flexibility of the alignment of the button assembly is increased. For example, since open space may be left below the key top of the push button, other unit can be positioned adjacent to the button assembly, contributing to the downsizing and sliming of the electronic device.

Another aspect of the invention is also a button assembly. The assembly comprises a cylindrical key top loosely inserted into a hole formed on a casing. The upper surface of the key top is a pressed face. The assemble further comprises a deformation member disposed below the key top in the pressing direction. The deformation member deforms to produce repulsive force when the key top is pressed down. The assemble further comprises a conductive member attached on the bottom of the deformation member, and switch contacts which come into contact with the conductive member and become conductive by the deformation of the deformation member. The central axis of the key top and the central axis of the conductive member are separated with certain spacing. The assembly further comprises a tilting prevention assembly which comprises a protrusion extending in the pressing direction from the side wall of the key top with certain length, and guiding member extending from the casing in the pressing direction with certain length to contact with said protrusion from at least two directions. When the key top is pressed down, the protrusion slides over the guiding member to prevent the key top from pivoting about the application point of force as a fulcrum.

According to this aspect, interference or contact between the hole and the key top may be prevented, resulting smooth button operation.

Still another aspect of the invention is an electronic device. The device comprises at least one button assembly having same features as the button assembly described above. According to this aspect, flexibility of the alignment of the button assembly on the electronic device may be improved.

Other unit may be positioned adjacent to the key top in the casing. A notch may be formed at lower part of the key top for avoiding interference with the other unit. The notch and the other unit may contact each other on surfaces parallel to the central axis of the key top. The contacting surfaces may function as a second tilting prevention assembly to control the movement of the key top in pressing direction. According to this aspect, other unit such as a liquid crystal display may be positioned adjacent to the button assembly.

DETAILED DESCRIPTION OF THE INVENTION

Figure 1:
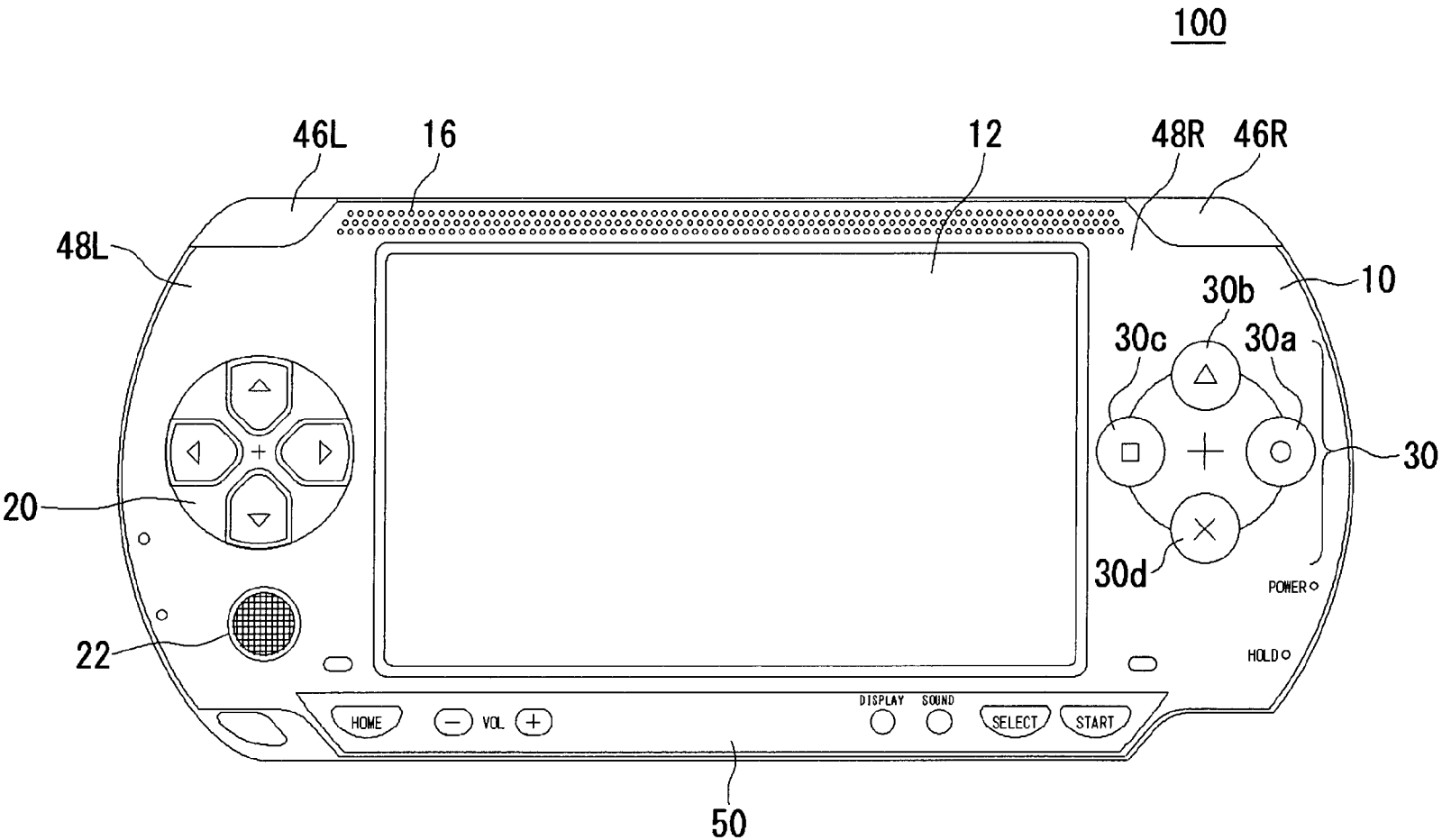
FIG. 1 is a front view of a portable electronic device according to one embodiment of the invention.
Figure 2:
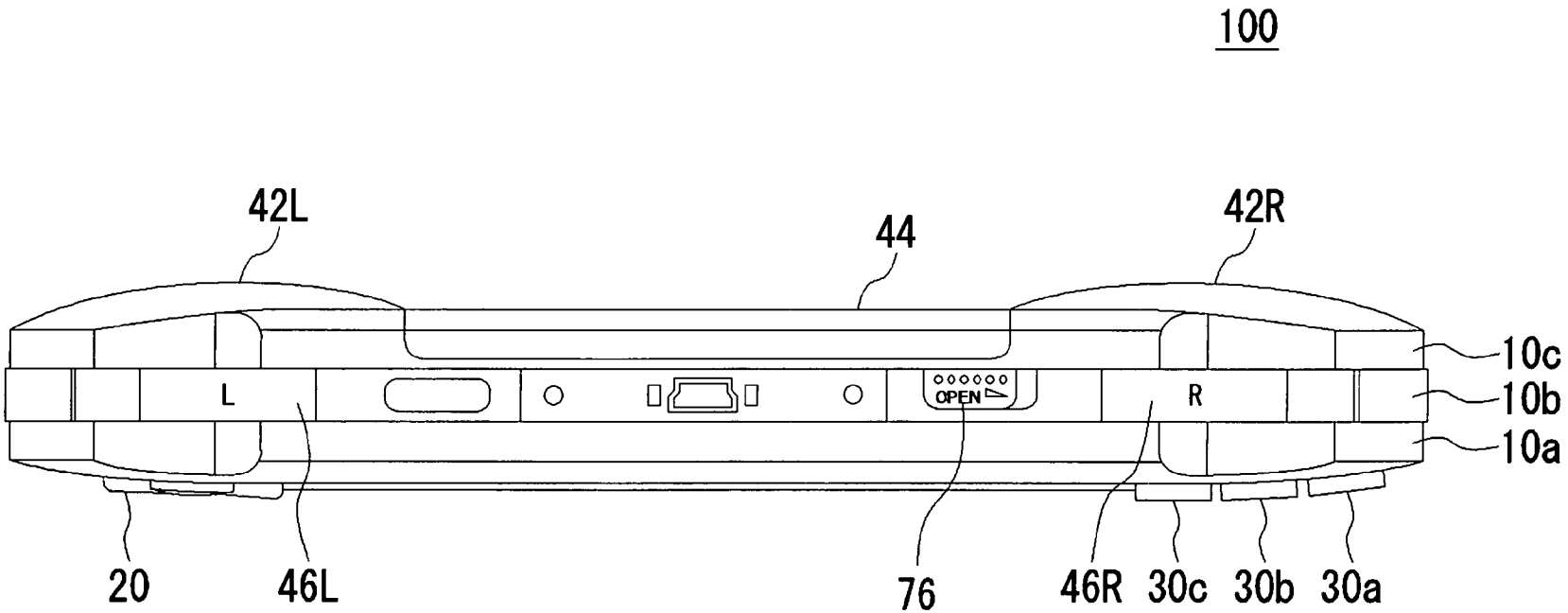
FIG. 2 is a top side view of the portable electronic device.

FIG. 1 and FIG. 2 are views showing the appearance of a portable electronic device 100 according to one embodiment of the present invention. FIG. 1 is a front view of the portable electronic device 100, and FIG. 2 is a top view of the portable electronic device 100. As shown in FIG. 1, a casing 10 has a horizontally long oval shape as a whole. Each end of the casing 10 is formed in a circular curve shape with its center decentered from a center line by a certain distance.

As shown in FIG. 2, the casing 10 is composed of an upper part 10*a*, an intermediate part 10*b*, and a lower part 10*c*. The casing 10 has a hollow body. Inside the casing 10, a circuit board (not shown) is provided. The circuit board includes: switch contacts for generating a signal by the operation of various corresponding buttons; a CPU which processes the signals so as to execute various computations; a sound processor for outputting a sound; and an image processor for outputting an image. The circuit board (not shown) is fixed to the upper part 10*a* or lower part 10*c*. The intermediate part 10*b* has a higher rigidity than those of the upper part 10*a* and the lower part 10*c* to ensure the rigidity of the entire casing 10.

Returning to FIG. 1, a liquid crystal display 12 (hereinafter, referred to as an "LCD 12") serving as a display device is fit into the center of the upper part 10*a* of the casing 10. The LCD 12 displays, for example, a game screen when the portable electronic device 100 functions as a game machine or displays a schedule or an address list when the portable electronic device 100 functions as a personal digital assistant (PDA).

Figure 3:
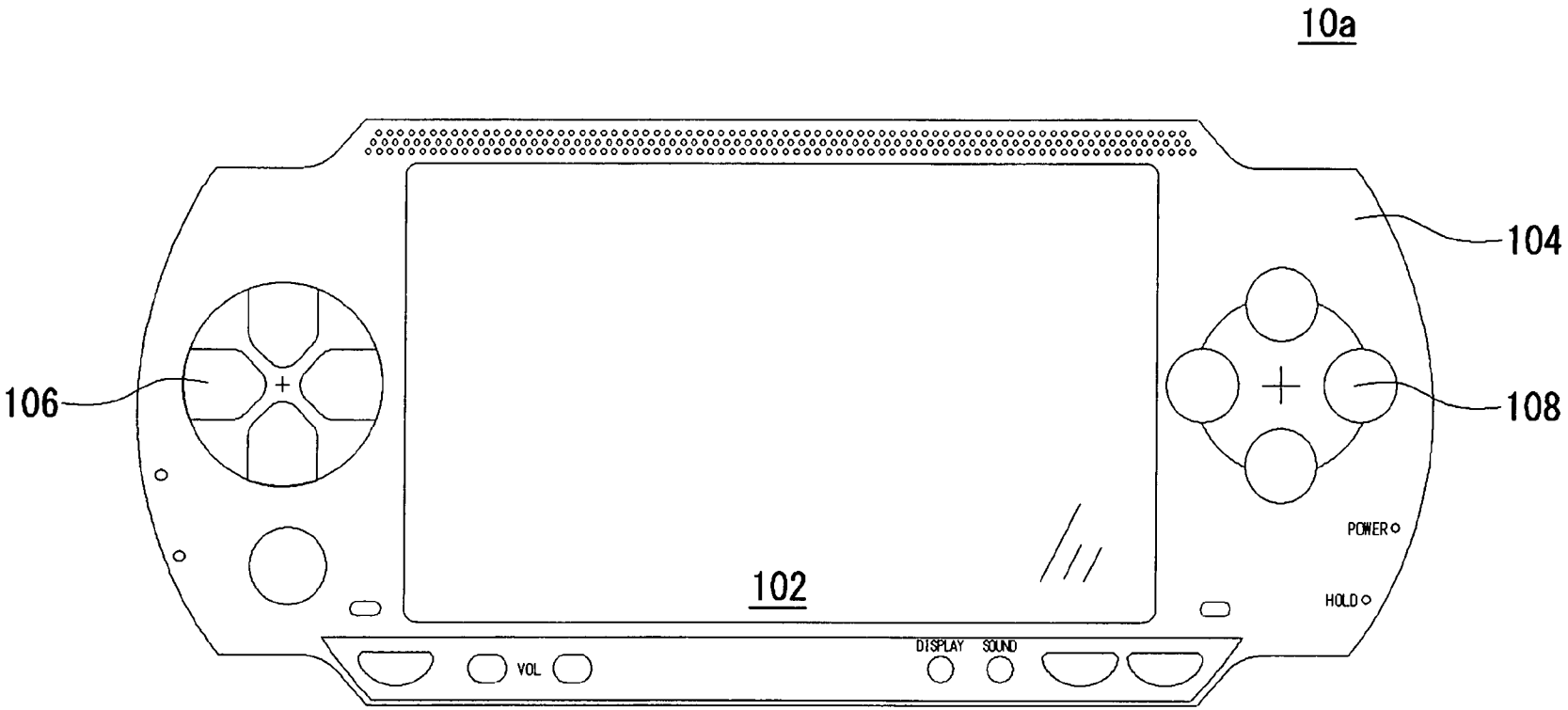
FIG. 3 is a front view of an upper part.

FIG. 3 is a front view of the upper part 10*a*. The upper part 10*a* is a molded resin part. The upper part 10*a* is arranged to cover the LCD 12 and various buttons disposed on the circuit board. The upper part 10*a* comprises a transparent window 102 and a frame 104. In the frame 104, substantially rectangle space for molding the transparent window 102, holes for various buttons and holes for viewing some LEDs are formed.

The transparent window 102 is formed of transparent resin materials for protecting the LCD 12 and ensuring visibility of the LCD 12. The frame 104 may be formed of the colored resin materials for covering the circuit board invisibly. The transparent window 102 and the frame 104 may be molded in one-piece using two-kind-of-resins molding technology, which two different color or two different material of resins are injected and molded at the same time.

Polycarbonate resin is preferable for the material of the transparent window 102 and the frame 104 because of its impact resistance and transparency. However, other materials such as acrylate resin may be employed. The transparent window 102 and the frame 104 may be molded of different materials.

Returning to FIG. 1, the surface of the upper part 10*a* of the casing 10, that is, the front face being opposite to the user is mainly composed of: a left-hand area 48L gripped by the left hand of the user; a right-hand area 48R gripped by the right hand of the user; the LCD 12; a horizontally long button area 50 positioned below the LCD 12, where various buttons are provided; and a decorative area 16 positioned above the LCD 12.

In the left-hand area 48L, an arrow key 20 mainly for inputting a direction indication and an analog device 22 mainly for analog input of the direction indication are provided.

In the right-hand area 48R, push buttons 30*a*, 30*b*, 30*c* and 30*d* (hereinafter, also collectively referred to as "push buttons 30") are provided mainly for inputting a unique instruction. Structure and function of the push buttons 30 will be described later.

The button area 50 is located in the vicinity of an outer edge of the upper part 10*a* of the casing 10 on the side closer to the user holding the portable electronic device 100. The button area 50 is the area where various buttons other than the arrow key 20, the analog device 22 and the push buttons 30 are arranged.

Referring to FIG. 2, dome-like bulges 42L and 42R are formed on both ends of the rear face of the casing 10. A plane is formed between the two bulges 42. Almost the entire plane is an open-cover part 44 of a small disc drive. By sliding a switch 76 provided in the intermediate part 10*b*, the cover opens upward in FIG. 2 so that a small disc can be loaded on a disc drive (not shown) below the open-cover part 44. The small disc drive provides an application program or a game program for the portable electronic device 100.

An L-button 46L are buttons operated by the left forefinger or left middle finger of the user. An R-button 46R are buttons operated by the right forefinger or right middle finger of the user. The L-button 46L and R-button 46R are preferably used for giving a special instruction that cannot be commanded only with the arrow key 20 or the push buttons 30.

Figure 4:
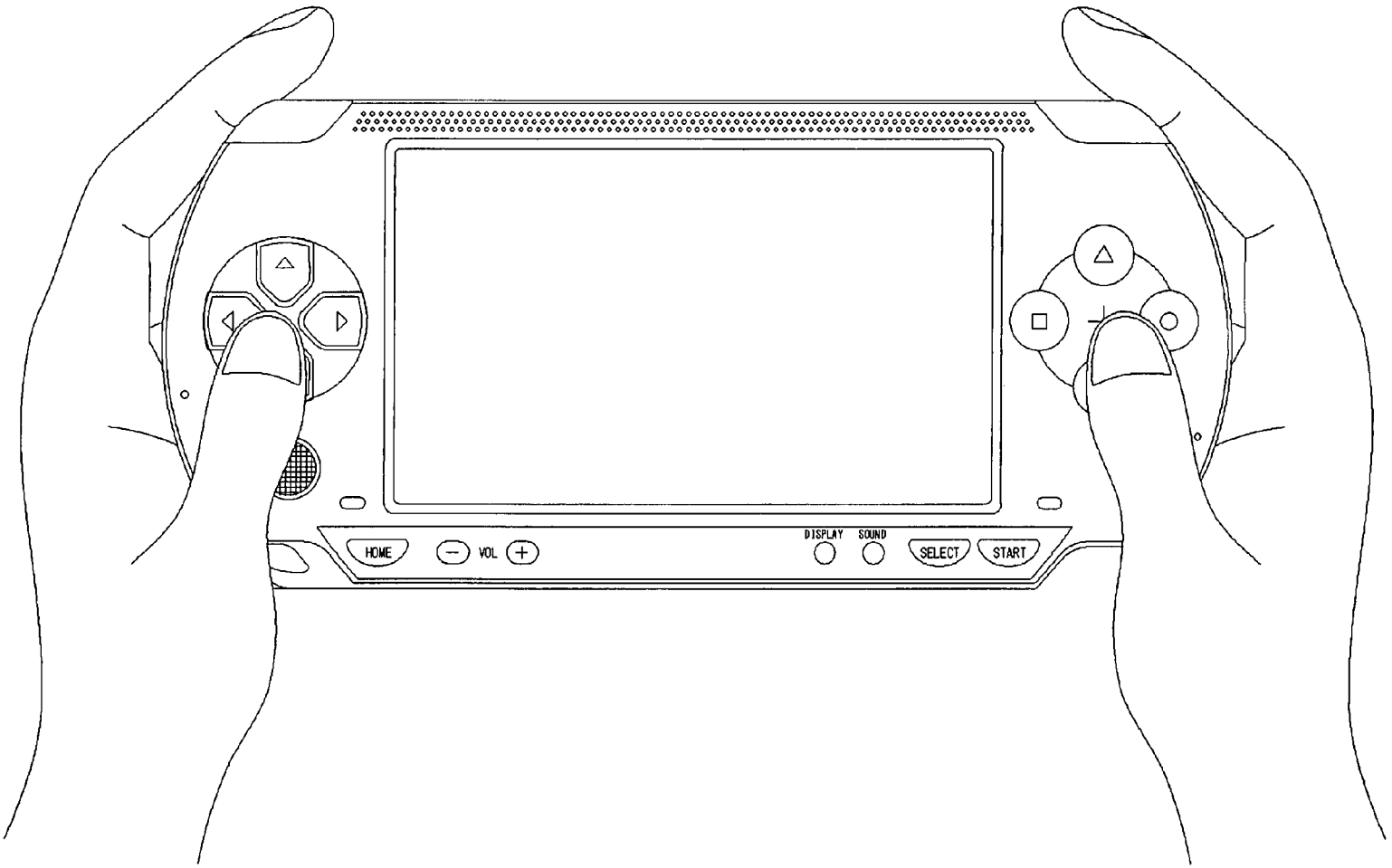
FIG. 4 is a view showing how the portable electronic device is gripped by the user.

FIG. 4 is a view showing how the portable electronic device 100 is gripped by the user. The portable electronic device 100 is basically operated while being held by the user's both hands. The left end of the casing 10 is held by the left hand. The right end of the casing 10 is held by the right hand. As shown in FIG. 4, the user's left hand is slightly flexed to hold the casing 10 along the arc shape side of the left-hand area 48L of the casing 10. At this time, the left thumb of the user is placed on the arrow key 20 to operate the arrow key 20. Similarly, the user's right hand is also slightly flexed to hold the casing 10 along the arc shape side of the right-hand area 48R. The right thumb of the user is placed on the center of the push buttons 30 to operate the push buttons 30. The user's middle finger, ring finger and little finger are put on the rear face of the casing 10. In this manner, the curve formed by the forefingers fits to the shape of the left and right side faces of the casing to help the user's grip. At the same time, the weight of the casing 10 is supported by the middle fingers to the little fingers. Therefore, the portable electronic device 100 can be stably supported even when the user releases his/her thumb or forefinger off the push buttons 30 for operation.

As shown in FIG. 1, the push buttons 30 includes buttons 30*a*, 30*b*, 30*c* and 30*d*. On the surfaces of cylindrical key tops, which is made of molded resin, of the buttons 30*a*, 30*b*, 30*c* and 30*d*, circle, triangle, square, and cross signs are indicted, respectively. Each of the push buttons 30*a*, 30*b*, 30*c* and 30*d* is used to input a single instruction. A deformation member for producing repulsive force, a conductive member stuck on the bottom of the deformation member, and the switch contacts are provided below each of key top of the push buttons 30*a*, 30*b*, 30*c* and 30*d*. When any one of the key tops of the push buttons 30*a*, 30*b*, 30*c* and 30*d* is pressed down, the deformation member disposed below the key top is deformed. Then the conductive member comes into contact with the switch contacts and the switch is turned ON. The assignment of the input type to each push button 30*a*, 30*b*, 30*c* or 30*d* differs depending on the type of the game program or the application running on the portable electronic device 100. For example, the push buttons 30*a*, 30*b*, 30*c* and 30*d* are used for input such as an attack in a game, item acquisition, menu screen display, item selection, or response to inquiry.

The push buttons 30*a*, 30*b*, 30*c* and 30*d* are provided at predetermined spacing so as to be placed at the four apexes of the square, as shown in FIG. 1. Therefore, if the user extends the right thumb, the user can operate the triangle button 30*b* and the square button 30*c* on the far side when viewed from the right hand side without changing the gripping position of the casing 10. When the right thumb is flexed, the user can operate the circle button 30*a* and the cross button 30*d* on the close side when viewed from the right hand side.

Figure 5A:
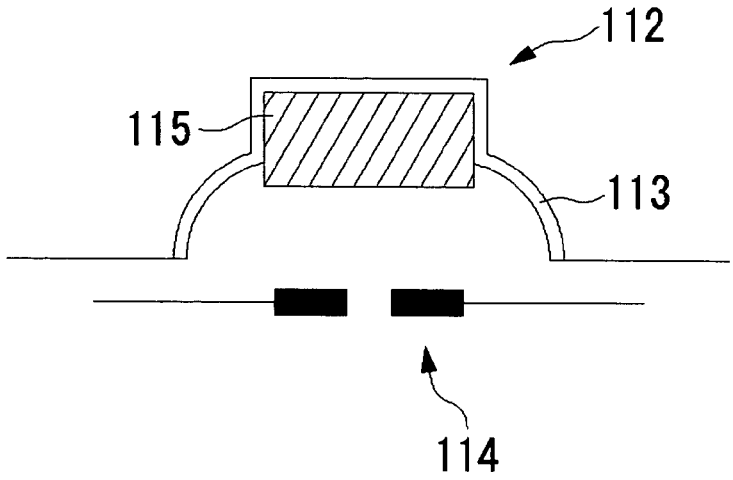
FIG. 5A shows how switch contacts become conductive by a push button.
Figure 5B:
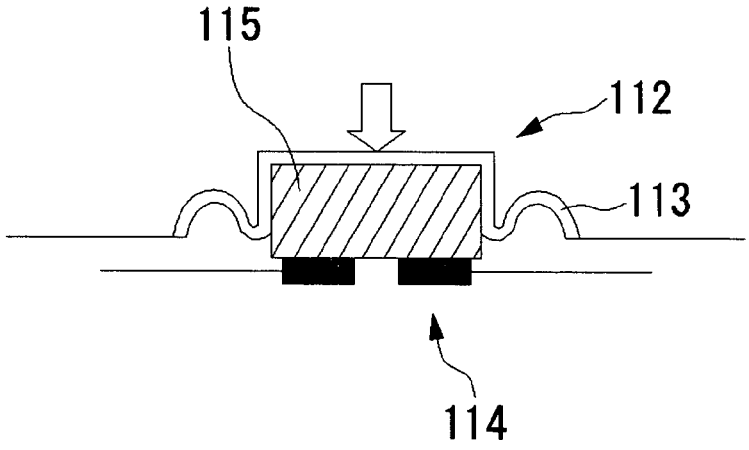
FIG. 5B shows how the switch contacts become conductive by the push button.

FIGS. 5A and 5B shows how the switch contacts become conductive by the push button. When the push button 30 is pressed down, it outputs digital signal in response to the press operation. More specifically, when the key top (not shown) of the push button is pressed down, the deformation member 112 provided below the key top is pressed and moves downward. The deformation member 112 includes a flexible leg 113 shown in FIG. 5A. Upon application of a predetermined or larger load, the leg 113 is greatly deformed as shown in FIG. 5B. The conductive member 115 is attached to the bottom of the deformation member 112. On a circuit board below the conductive member 115, switch contacts 114 separated from each other are provided. By the deformation of the leg 113, the conductive member 115 comes into contact with the switch contacts 114. Then, the switch contacts 114 are electrically conducted to transmit an ON signal of the switch to the CPU. When the user takes the finger off the key top (not shown), the elasticity of the leg 113 puts the key top back to its original position as shown in FIG. 5A. The shape and the elasticity of the leg 113 of the deformation member 112 is designed such that the leg 113 is deformed to contact with the switch contacts 114 on application of a predetermined or larger load, and that the leg 113 gets back to original shape when the load application is removed. Thus, the user can feel a "click" of the push button, So the user can confirm his operation. The deformation member 112 may be formed of rubber, silicon or plastic, for example.

As shown in FIG. 1, the push button 30*c* is arranged adjacent to the LCD12 in the portable electronic device 100. The reason is as follows: there is a demand to downsize the portable electronic device; there is a demand to enlarge the LCD 12 for improving the visibility and impressiveness; and there is a demand to arrange the push buttons with good balance while reserving the size of the push buttons for operability. In consideration of these demands, the arrangement of the push buttons is determined. In the portable electronic device according to this embodiment, the packaging density of various parts and circuit boards has been increasing because of the advancement of the function and the downsizing of the casing. So, it is one of problems of the design how to arrange parts and circuit boards within the casing. In addition, there is a limit for downsizing the push button to keep operability. Therefore, in some cases, some push buttons need to be arranged adjacent to other unit such as the LCD as shown in FIG. 1

Figure 6:
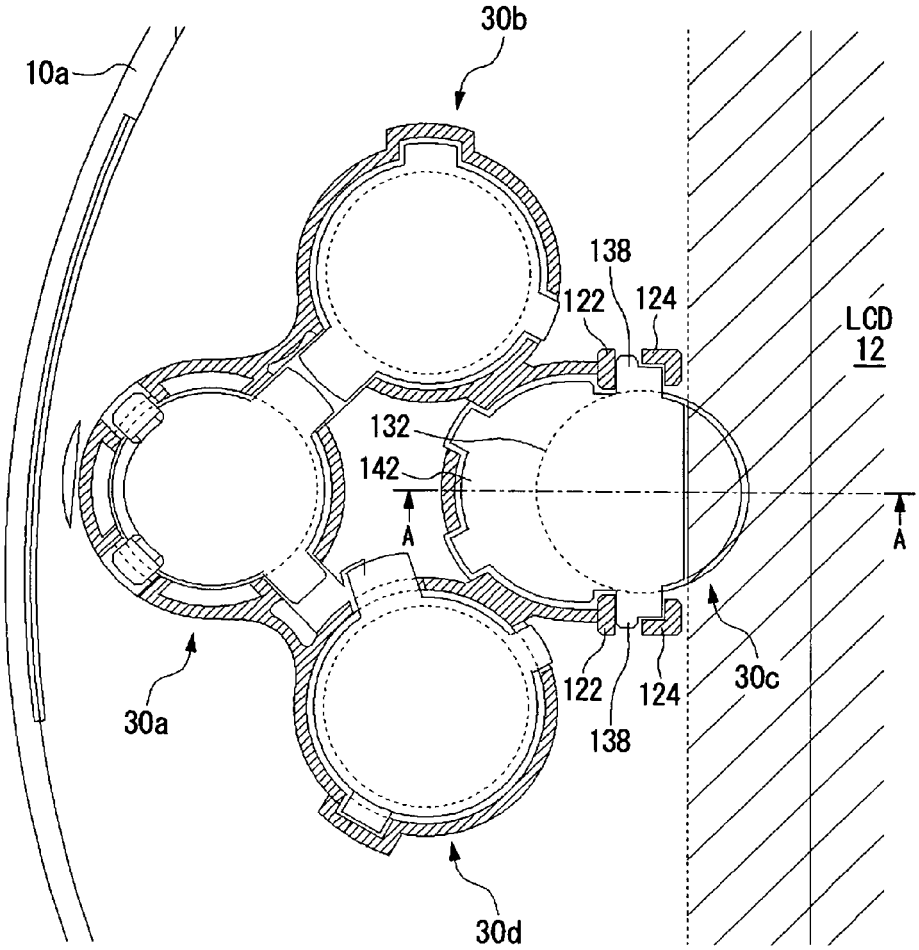
FIG. 6 is a view of the push button from the backside of the upper part.

FIG. 6 is a view of the right-hand area 48R, where the push buttons 30 are arranged, from the backside (that is, inner side of the casing 10) of the upper part 10*a*. In the backside of the upper part 10*a*, guiding structure (shown with hatching in FIG. 6) for accommodating the key top of each push button is formed. As shown, guiding structure can be formed to surround all circumferences of the key top of the push buttons 30*a*, 30*b* and 30*d*. However, as to the push button 30*c*, guiding structure cannot be formed to surround all circumferences of the key top because of the interference of the LCD 12 located at the right side in FIG. 6.

Figure 7:
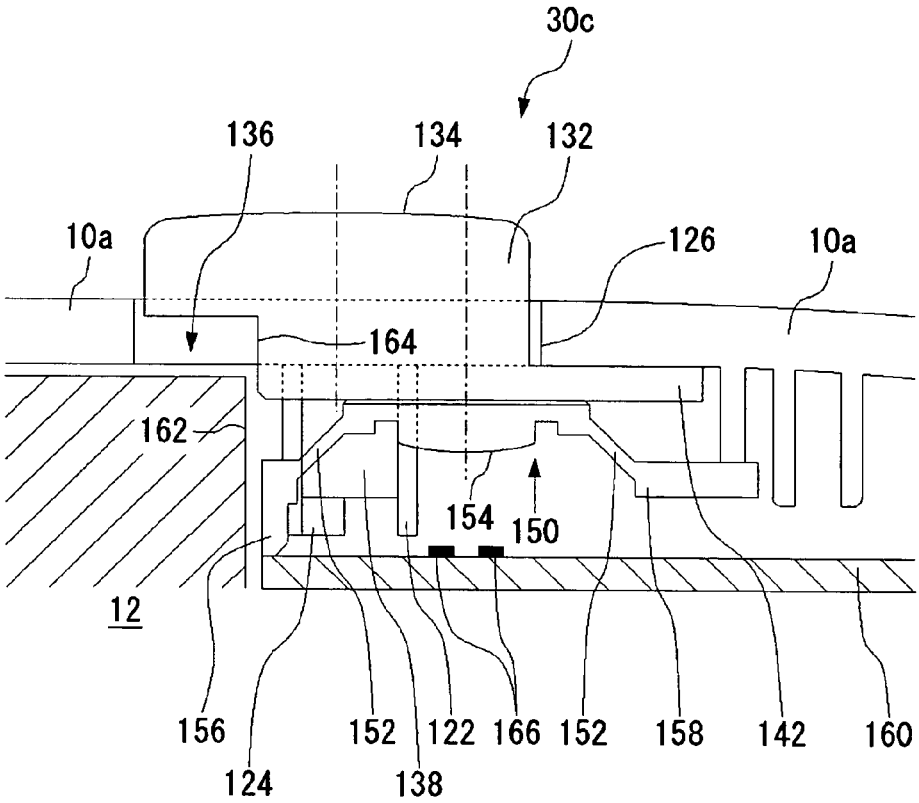
FIG. 7 is an A—A sectional view of FIG. 6.

FIG. 7 is an A—A sectional view of FIG. 6. FIG. 7 also shows the deformation member and the circuit board with the front face of the casing 10 upward. As shown, when the push button 30*c* is positioned adjacent to the LCD 12, the base of the LCD 12 locates below the key top 132 of the button 30*c*. Therefore, a deformation member 150 and switch contacts 166 for the push button 30*c* cannot be positioned just below the key top 132.

Thus, when the deformation member or the conductive member cannot be disposed just below the key top because of difficulties in design or structure, in other words, when there is some distance between a central axis of the key top and that of the deformation member or the conductive member, a point of application of force is located at contact point between the key top and the deformation member when a user presses down a pressed face 134 of the push button 30*c*. Then, since the pressing direction and the application point of force is not situated coaxially, the key top 132 may pivot about the application point of force, resulting to tilting of the key top 132. In this case, the key top 132 may interfere or slide over a hole 126 in the upper part 10*a*, and smooth button operation may be degraded.

Even if the pressing point and the application point of force is not located coaxially, moment of the key top may be lowered when the application point is located with certain distance in pressing direction from the pressing point. In such a case, the problem stated above may be solved. However, in the portable electronic device, long member in pressing direction (that is, the thickness direction of the casing) cannot be provided for achieving slim casing.

Therefore, in this embodiment, a tilting prevention assembly which contains a short member in pressing direction and controls the movement of the key top in vertical direction (that is, the moving direction of the push button pressed by the user) is employed to solve the problem stated above.

Figure 8:
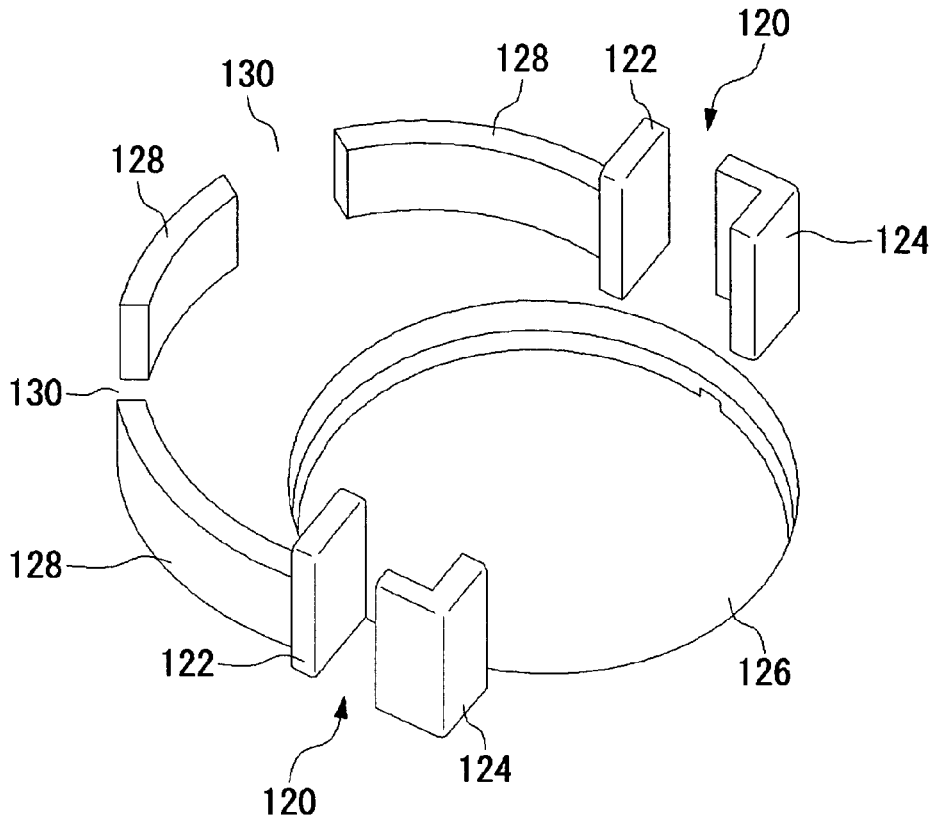
FIG. 8 shows the structure for accommodating a button molded part formed on the backside of the upper part.

FIG. 8 shows guiding member and arced ribs for accommodating a button molded part 140 formed on the backside of the upper part 10*a*. The guiding member 120 is formed as extending upward (that is, extending to back face of the casing) from the backside of the upper part 10*a*. In this embodiment, the guiding member 120 comprises a rectangular flat plate 122 and a L-shaped plate 124 (hereinafter referred to as an "L-plate 124") having an L-shaped section. The flat plate 122 and the L-plate 124 are provided adjacent to the hole 126, where the key top of the button molded part 140 is loosely inserted, formed in the upper part 10*a*. The flat plate 122 and the L-plate 124 are located opposite side of the hole 126. Preferably, the line between the center of the hole 126 and half circle formed by the arced ribs 128, and the line between two guiding members at opposite side of the hole 126, intersect perpendicularly. The spacing between the flat plate 122 and the L-plate 124 is designed to receive a protrusion 138 described below with some gap. The spacing between the flat plate 122 and the L-plate 124 prevents the projection 148 of the protrusion 138 from contacting with surfaces of the flat plate 122 and the L-plate 124.

Two guiding member 120 may be provided at opposite sides of the hole 126. However, when the strength of the guiding member 120 is high, for example, the guiding member is made of metal or the plate is thick enough, only one guiding member 120 may be provided at either side of the hole 126. The guiding member 120 is formed longer than the moving distance in pressing direction of the button molded part 140.

At the side of the hole 126 where no guiding member 120 is provided, two or more arced ribs 128 are formed where a hang-over member of the button molded part and part of the deformation member are accommodated. The arced ribs 128 are formed such that two or more spacing are provided between the arced ribs 128. In FIG. 8, two spacing 130 are provided between the arced ribs 128.

Figure 9:
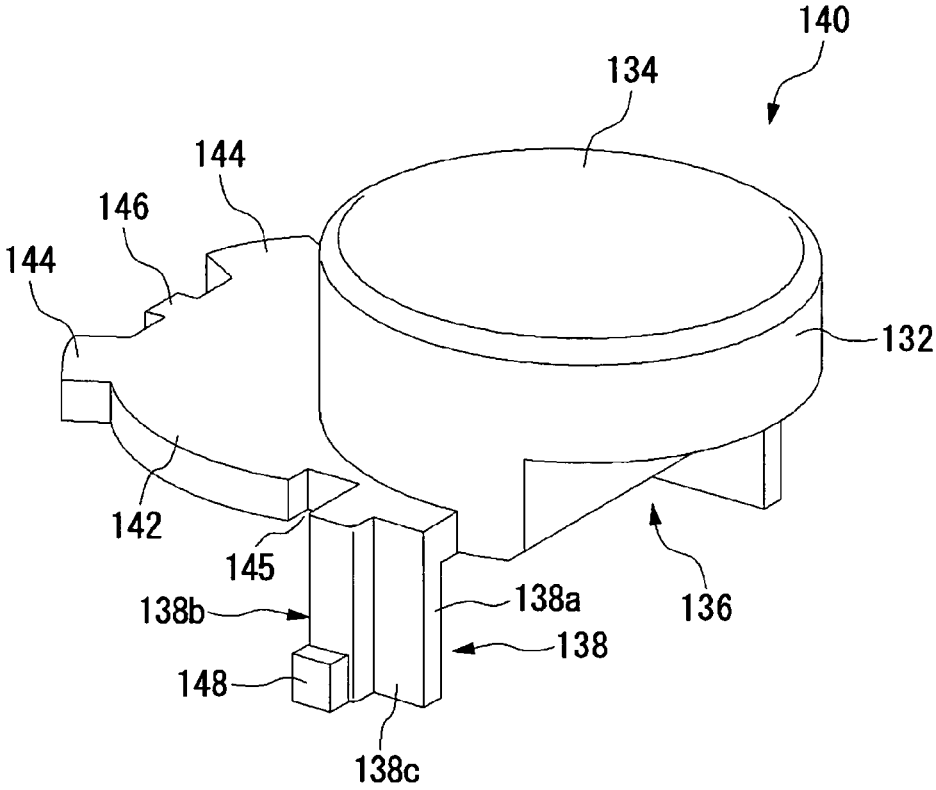
FIG. 9 shows the button molded part viewed from a front side.
Figure 10:
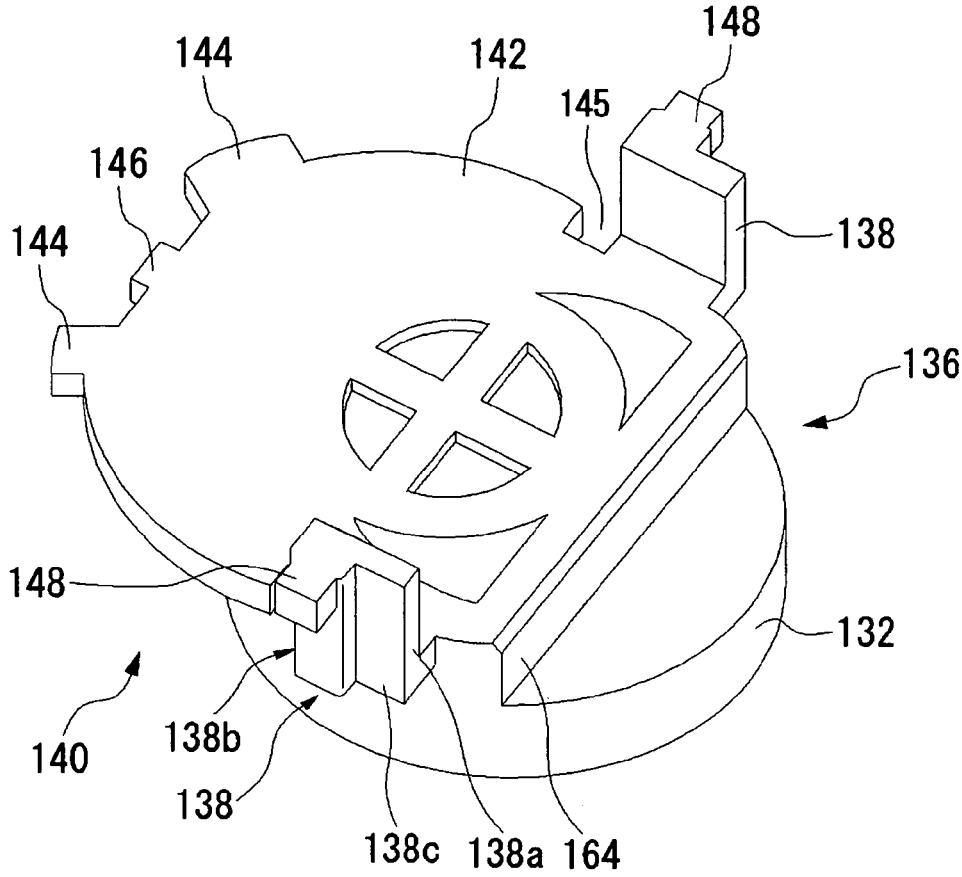
FIG. 10 shows the button molded part viewed from a backside.

FIGS. 9 and 10 show an overall structure of the button molded part 140. The button molded part 140 is molded with resin in one-piece. FIG. 9 shows the button molded part 140 viewed from a front side (that is, from a side where the pressed face 134 viewed by the user is upward). FIG. 10 shows the button molded part 140 viewed from a backside. In later explanation, both FIG. 9 and FIG. 10 are referred.

The button molded part 140 mainly comprises a cylindrical key top 132, a hang-over member 142 extending laterally in FIG. 9 from lower end of the key top 132, and a protrusion 138 extending downward in FIG. 9 from the side wall of the key top 132.

The key top 132 is a part where the user applies force to press down for operation by his/her thumb or other finger. The pressed face 134 of the key top 132 is formed slightly roundly for improving the operation feeling of the user. On the pressed face 134, signs such as circle, cross, triangle, and square shown in FIG. 1 are printed or engraved for indicating the difference between push buttons to the user.

A notch 136 is formed in the key top 132 such that part of side wall of the key top 132 is cut off from its middle to bottom. The notch 136 is formed to avoid interference between the key top 132 and other unit such as an LCD, as described later.

From the lower end of the side wall having no notch 136, the hang-over member 142 extending above at least the central axis of the conductive member shown in FIG. 7 is formed. The hang-over member 142 is substantially parallel to the pressed face 134. The tip of the hang-over member 142 is formed as substantially half circle according to the arced ribs 128 shown in FIG. 8. Other shape may be employed. Projections 144 are formed in the hang-over member 142. A projection 146 is a pouring gate for resin molding.

From the lower end of the side wall having no notch 136 and no hang-over member 142, two protrusions 138 are formed on both sides of the key top 132 such that each of the protrusions 138 is substantially positioned at the both sides of the diameter of the pressed face 134, respectively. The protrusion 138 extends for predetermined length in button pressing direction. A section of the protrusion 138 is L-shaped. Surfaces 138*a*, 138*b* and 138*c* slide over the guiding member 120. The protrusion 138 is designed to be accommodated into the guiding member 120 shown in FIG. 8 with some gap. A projection 148 is a pouring gate for resin molding.

Figure 11:
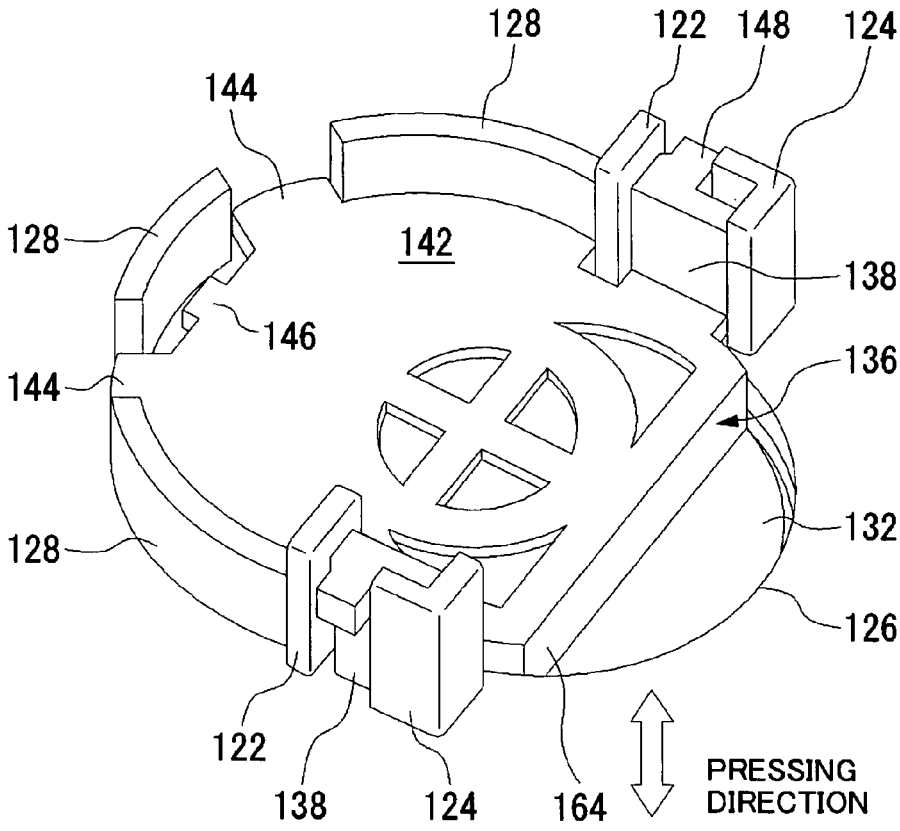
FIG. 11 is a view showing how the button molded part is accommodated into a guiding member and arced ribs shown in FIG. 8.

FIG. 11 is a view showing how the button molded part 140 is accommodated into the guiding member 120 and the arced ribs 128 of FIG. 8. The key top 132 is loosely inserted to the hole 126 of the upper part 10*a* and is protruded for predetermined length from the front surface of the casing 10. Thus, user can recognize the push button. As shown in FIG. 11, the protrusion 138 is accommodated between the flat plate 122 and the L-plate 124 of the guiding member 120. The hang-over member 142 is accommodated so that its circumference follows along the inside wall of the arced ribs 128. The projection 144 is accommodated into the spacing between the arced ribs 128. Part of the flat plate 122 is received into a dent 145 (see FIG. 9 and FIG. 10) adjacent to the connection part between the key top 132 and the hang-over member 142. The hang-over member 142, the projection 144 and the dent 145 guides the movement of the button molded part 140 when the button molded part 140 is pressed down.

The hang-over member 142 and the protrusion 138 come into contact with the upper part 10*a* from the backside and also functions as a stopper to prevent the button molded part 140 from being separated from the upper part 10*a*.

When center area of the pressed face 134 of the button is pressed down, the surface 138*b* of the protrusion 138 comes into contact with the inner side of the flat plate 122 (that is, the side confronting to the L-plate 124), and the surface 138*a* of the protrusion 138 comes into contact with the inner side of the L-plate 124. By these contacting surfaces, tilting angle of the button molded part 140 is limited when the key top 132 is pressed down. When rim area of the pressed face 134 of the button is pressed down, the surface 138*c* of the protrusion 138 comes into contact with the inner side of the L-plate. 124. By these contacting surfaces, tilting angle of the button molded part 140 is limited when the key top 132 is pressed down.

As described above, the protrusion 138 is accommodated into the guiding member 120 from at least two direction of the circumstance of the protrusion 138. Thus, when the user presses down the pressed face 134 of the push button, surfaces 138*a*, 138*b* and 138*c* slide over the contacting surfaces of the flat plate 122 and the L-plate 124 of the guiding member 120. Since the moving of the button molded part 140 is limited to the pressing direction (shown as an outline arrow in FIG. 11), the button molded part 140 can moves smoothly without the key top 132 being tilt or contacting with the hole 126.

The surface 138*b* of the protrusion 138 comes into contact with the inner side (the side confronting to the L-plate 124) of the flat plate 122, and the surface 138*a* of the protrusion 138 comes into contact with the L-plate 124. These surfaces are perpendicular to the line between the pressing point and the application point of force. The outward surface 138*c* of the protrusion 138 contacts with the L-plate 124. In other words, the protrusion 138 slides over three contacting surfaces with the guiding member 120. Thus, the area of sliding surfaces between the protrusion 138, the flat plate 122 and the L-plate 124 is large, force applied to the guiding member 120 from the protrusion 138 is widely dispersed when the push button is pressed, resulting to reduce the friction of the button molded part 140 and make its movement more smoothly.

It is preferable to enlarge the length of the protrusion 138 in the pressing direction in view of reducing the tilting degree of the key top on pressing. However, there is certain limit of the length of the protrusion 138 in the pressing direction because of the demand for slim package of the portable electronic device 100. In this embodiment, the protrusion 138 extends not from the bottom (that is, surface confronting to the center of the casing 10) of the key top 132 but from the side wall of the key top 132. Thus, it is possible to reserve some length of the protrusion 138 in pressing direction while reducing the height of the button molded part 140 as possible.

The guiding member 120 is preferably positioned such that the line between two guiding members 120 at both sides of the hole 126 should intersect with midpoint of the line between the central axis of the key top 132 and that of the deformation member or the conductive member. By this, force applied to the guiding member 120 from the protrusion 138 may be reduced when the key top 132 is pressed. This contributes to the smooth operation of the button molded part 140.

Figure 12:
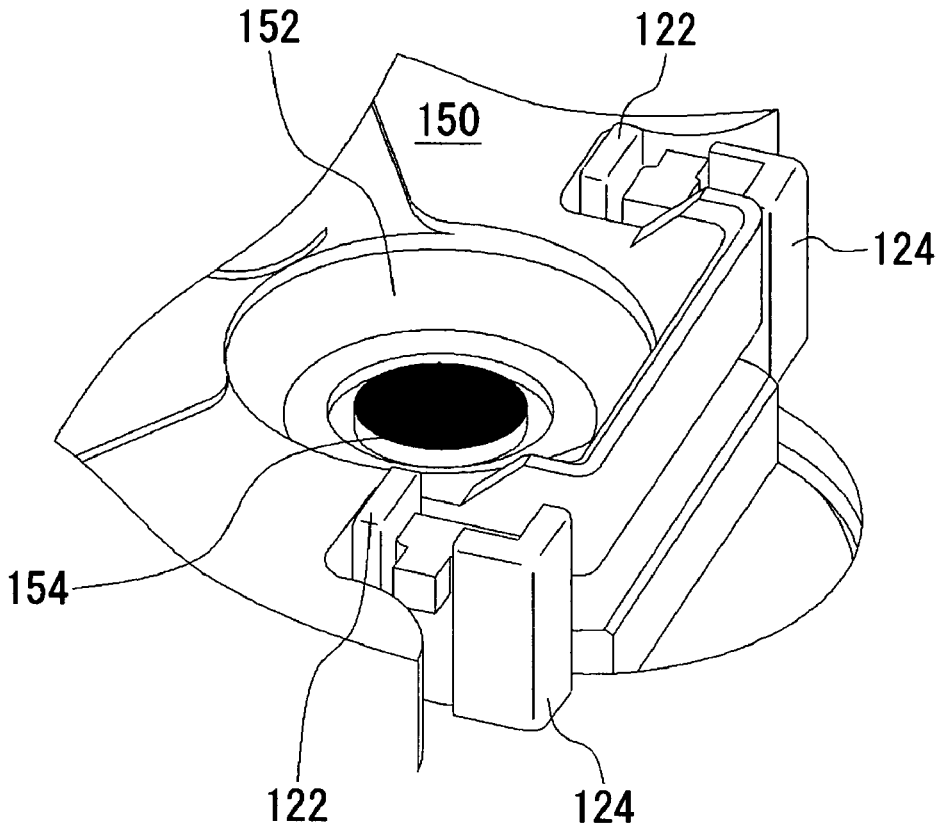
FIG. 12 is a view showing how a deformation member with a conductive member is accommodated into the guiding member and the arced ribs shown in FIG. 8.

FIG. 12 is a view showing how the deformation member 150 with the conductive member 154 is accommodated into the guiding member 120 and the arced ribs 128 formed on the backside of the upper part 10*a*. The deformation member 150 is made of elastic material such as rubber, and the conductive member 154 is attached onto the bottom of the deformation member 150. In FIG. 12, part of the deformation member 150 is illustrated. It should be noted that the deformation member 150 has four deformation part and four conductive members for four push buttons 30.

As shown, part of the deformation member 150 is accommodated between two opposed guiding members 120. Then, the conductive member 154 is arranged in the center of the hang-over member 142 of the button molded part 140. Hereby, pressing of the conductive member 154 by the hang-over member 142 is ensured.

Returning to FIG. 7, in this embodiment, the central axis of the key top 132 and the application point of force to the deformation member 150 (that is, the contacting point between the central axis of the conductive member 154 and bottom surface of the hang-over member 142) are not located coaxially but are separated with some distance. Thus, it is possible that, when the user presses down the pressed face 134, the key top 132 would be pivot about the application point of force as a fulcrum. In this case, the user cannot sense the click feeling when the user presses down the push button. In addition, though the user presses down the push button, the conductive member 154 would not come into contact with the switch contacts 166 and no input signal would be produced because of pivot movement of the button molded part 140. Furthermore, since the button molded part 140 comes into contact with the hole 126 or other parts, smooth movement of the button would be lost. To solve such problems, tilting prevention assembly composed of the guiding member 120 and the protrusion 138 of the button molded part 140 is provided. The tilting prevention assembly controls the movement of the button molded part 140 to the pressing direction even if the pressing direction and the application point of force are not located coaxially.

In this embodiment, other unit such as the LCD 12 is positioned adjacent to the button assembly such that part of the other unit is located below the pressed face 134. To prevent the interference between the other unit and the button assembly, the notch 136 is formed at lower end of the key top 132. Thus, when the push button is pressed down, a side face 164 of the notch 136 contacts with and slides over a side face 162 of the other unit (LCD) 12. Tilting or pivoting of the key top 132 may be prevented by such contacting surfaces. Therefore, such contacting surfaces also function as tilting prevention assembly for controlling the movement of the button molded part 140.

In another embodiment, the guiding member may comprise two opposed flat plates. In this case, the protrusion of the button molded part may be accommodated between the two opposed flat plates. Alternatively, the guiding member may comprise a U-shaped rib. In this case, the protrusion of the button molded part may be accommodated into the dent of the U-shaped rib.

The present invention has been described based on some embodiments. The above-described embodiments are merely exemplary. Thus, those skilled in the art would understand that various modifications are possible in combinations with the components and such modifications are within the scope of the present invention. Moreover, an arbitrary combination of the components described in the embodiments is also effective as an embodiment of the present invention.

What is claimed is:

1. A button assembly, comprising:

a casing;

a cylindrical key top loosely inserted into a hole formed on said casing, wherein the upper surface of the key top is a pressed face;

a deformation member disposed below said key top in the pressing direction, wherein said deformation member deforms to produce repulsive force when said key top is pressed down;

a conductive member attached on the bottom of said deformation member;

switch contacts which come into contact with said conductive member and become conductive by the deformation of said deformation member; and a tilting prevention assembly for controlling the movement of said key top in the pressing direction to prevent tilting of said key top, wherein said tilting prevention assembly comprises:

a protrusion extending in the pressing direction from the side wall of said key top with certain length; and guiding member extending from said casing in the pressing direction with certain length to accommodate said protrusion from at least two directions, wherein said protrusion slides over said guiding member when said key top is pressed down, wherein said protrusion and said guiding member are positioned to contact with each other via at least one surface, and said one surface receives moment of said key top due to the separation between a central axis of said key top and a central axis of said conductive member when said key top is pressed down, wherein said protrusion has at least three surfaces extending in the pressing direction, said guiding member comprises a flat plate and an L-shaped plate having an L-shaped cross section opposite to said flat plate, wherein one surface of said flat plate and two surfaces of said L-shaped plate are positioned on said casing to be in front of three surfaces of said protrusion.

2. An electronic device having at least one button assembly disposed on a surface of a casing, said button assembly comprising:

a cylindrical key top loosely inserted into a hole formed on the casing, wherein the upper surface of the key top is a pressed face;

a deformation member disposed below said key top in the pressing direction, wherein said deformation member deforms to produce repulsive force when said key top is pressed down;

a conductive member attached on the bottom of said deformation member;

switch contacts which come into contact with said conductive member and become conductive by the deformation of said deformation member; and a tilting prevention assembly for controlling the movement of said key top in the pressing direction to prevent tilting of said key top, wherein said tilting prevention assembly comprises:

a protrusion extending in the pressing direction from the side wall of said key top with certain length; and guiding member extending from the casing in the pressing direction with certain length to accommodate said protrusion from at least two directions, wherein said protrusion slides over said guiding member when said key top is pressed down, wherein said protrusion and said guiding member are positioned to contact with each other via at least one surface, and said one surface receives moment of said key top due to the separation between a central axis of said key top and a central axis of said conductive member when said key top is pressed down, wherein said protrusion has at least three surfaces extending in the pressing direction, said guiding member comprises a flat plate and an L-shaped plate having an L-shaped cross section opposite to said flat plate, wherein one surface of said flat plate and two surfaces of said L-shaped plate are positioned to be in front of three surfaces of said protrusion.

3. An electronic device having at least one button assembly disposed on a surface of a casing, said button assembly comprising:

a cylindrical key top loosely inserted into a hole formed on the casing, wherein the upper surface of the key top is a pressed face;

a deformation member disposed below said key top in the pressing direction, wherein said deformation member deforms to produce repulsive force when said key top is pressed down;

a conductive member attached on the bottom of said deformation member;

switch contacts which come into contact with said conductive member and become conductive by the deformation of said deformation member; and a tilting prevention assembly for controlling the movement of said key top in the pressing direction to prevent tilting of said key top, wherein said tilting prevention assembly comprises:

a protrusion extending in the pressing direction from the side wall of said key top with certain length; and guiding member extending from the casing in the pressing direction with certain length to accommodate said protrusion from at least two directions, wherein said protrusion slides over said guiding member when said key top is pressed down, wherein other unit is located adjacent to said key top within said casing, a notch is formed at lower end of said key top to avoid interference with said other unit, said notch and said other unit contacts each other on surfaces parallel to the central axis of said key top, the contacting surfaces function as a second tilting prevention assembly to control the movement of said key top in the pressing direction.

* * * * *